US007259311B2

(12) United States Patent
Ashida

(10) Patent No.: US 7,259,311 B2
(45) Date of Patent: Aug. 21, 2007

(54) MOBILE COMMUNICATION TERMINAL WITH AUDIO TUNING FUNCTION

(75) Inventor: Kazumasa Ashida, Tokyo (JP)

(73) Assignee: NEC Corporation, Tokyo (JP)

( * ) Notice: Subject to any disclaimer, the term of this patent is extended or adjusted under 35 U.S.C. 154(b) by 60 days.

(21) Appl. No.: 11/073,542

(22) Filed: Mar. 8, 2005

(65) Prior Publication Data

US 2005/0211065 A1 Sep. 29, 2005

(30) Foreign Application Priority Data

Mar. 11, 2004 (JP) ..... 2004-069178

(51) Int. Cl.
*G10G 7/02* (2006.01)

(52) U.S. Cl. ..... 84/454; 84/455; 84/600; 84/602; 84/615; 84/616; 84/477 R

(58) Field of Classification Search ..... None
See application file for complete search history.

(56) References Cited

U.S. PATENT DOCUMENTS 5,016,515 A * 5/1991 Scott ..... 84/454
5,973,252 A * 10/1999 Hildebrand ..... 84/603
6,894,212 B2 * 5/2005 Capano ..... 84/454
2002/0088333 A1 * 7/2002 Skubic ..... 84/477 R
2004/0020346 A1 * 2/2004 Kondo ..... 84/454
2004/0025672 A1 * 2/2004 Carpenter ..... 84/622
2004/0139841 A1 * 7/2004 Capano ..... 84/454
2006/0185501 A1 * 8/2006 Shiraishi et al. ..... 84/612

FOREIGN PATENT DOCUMENTS

JP 2002-49368 2/2002

* cited by examiner

*Primary Examiner*—Marlon Fletcher
(74) *Attorney, Agent, or Firm*—Whitham Curtis Christofferson & Cook, PC

(57) ABSTRACT

A mobile communication terminal provided with a tuning function, which saves a player the trouble of carrying around a tuning meter or the like and facilitates the tuning of instruments. A user designates a reference pitch stored in a memory, and inputs the sound of an instrument or a voice into a microphone. A synthesizer generates a sound that most approximates the sound input through the microphone according to the reference pitch designated by the user. The sound generated by the synthesizer is compared with the sound input through the microphone, and the result of the comparison is displayed on a display.

6 Claims, 4 Drawing Sheets

MOBILE COMMUNICATION TERMINAL WITH AUDIO TUNING FUNCTION

FIELD OF THE INVENTION

The present invention relates to a mobile communication terminal with an audio tuning function, more particularly, to a mobile communication terminal which produces a reference tone for a musical performance and picks up instrumental sounds and voiced sounds, thus enabling the pitch of each note to be checked.

BACKGROUND OF THE INVENTION

Before playing an instrument or singing, the player, singer, etc. adjusts the pitch for playing or singing musical notes correctly based on a reference tone using a tuning fork or a tuner.

Besides, when playing an instrument, the player or the like has to tune the instrument in advance so that it plays at the correct pitch. In this case, the player tunes the instrument while checking the pitch of each note with a tuning meter. Consequently, the player is required to carry the tuning meter into a venue for a concert each time he/she gives a performance as well as to take care of it.

If a cellular phone, which has been in widespread use, has a tuning function as for example described in Japanese Patent Application laid open No. 2002-49368, the player need not carry around the tuning meter.

SUMMARY OF THE INVENTION

It is therefore an object of the present invention to provide a mobile communication terminal, such as a cellular phone, having a tuning function, which facilitates the tuning of instruments or the like.

In accordance with the first aspect of the present invention, to achieve the object mentioned above, there is provided a mobile communication terminal with a tuning function, comprising a memory for storing a plurality of reference tones or pitches for tuning, a selector for selecting at least one of the reference tones stored in the memory, an inputting means for inputting an instrumental sound or a voiced sound, a sound generator for generating a sound whose frequency approximates that of the instrumental sound or the voiced sound input through the inputting means and which corresponds to the reference tone selected by the selector, a comparator for comparing the sound generated by the sound generator with the sound input through the inputting means, and a display for displaying the result of the comparison obtained by the comparator.

In accordance with the second aspect of the present invention, in the mobile communication terminal with a tuning function of the first aspect, the sound generator generates a sound corresponding to the reference tone selected by the selector to output the sound.

In accordance with the third aspect of the present invention, in the mobile communication terminal with a tuning function of the first aspect, the sound generator generates sounds sequentially from the highest or lowest sound (note) based on the reference tone selected by the selector.

In accordance with the fourth aspect of the present invention, in the mobile communication terminal with a tuning function of the first aspect, the sound generator generates a sound corresponding to the reference tone selected by the selector, the mobile communication terminal further comprising a sound wave superimposing means for superimposing the frequency of the sound generated by the sound generator on that of the instrumental sound or the voiced sound input through the inputting means.

In accordance with the fifth aspect of the present invention, the mobile communication terminal with a tuning function of the fourth aspect further comprises a detector for detecting the smallest phase difference and the smallest frequency difference between the two waves superimposed one on the other by the sound wave superimposing means.

In accordance with the sixth aspect of the present invention, in the mobile communication terminal with a tuning function of the fifth aspect, the sound generator generates a sound with the phase and the frequency detected by the detector, and the display indicates the sound generated by the sound generator.

As described above, in accordance with the present invention, a mobile communication terminal is provided with a tuning function, which saves a player, singer, etc. the trouble of carrying around a tuning meter or the like and facilitates the tuning of instruments.

BRIEF DESCRIPTION OF THE DRAWINGS

The objects and features of the present invention will become more apparent from the consideration of the following detailed description taken in conjunction with the accompanying drawings in which:

FIG. 1(*b*) is a diagram showing the back view of the cellular phone depicted in FIG. 1(*a*);

DESCRIPTION OF THE PREFERRED EMBODIMENT

Figure 1:
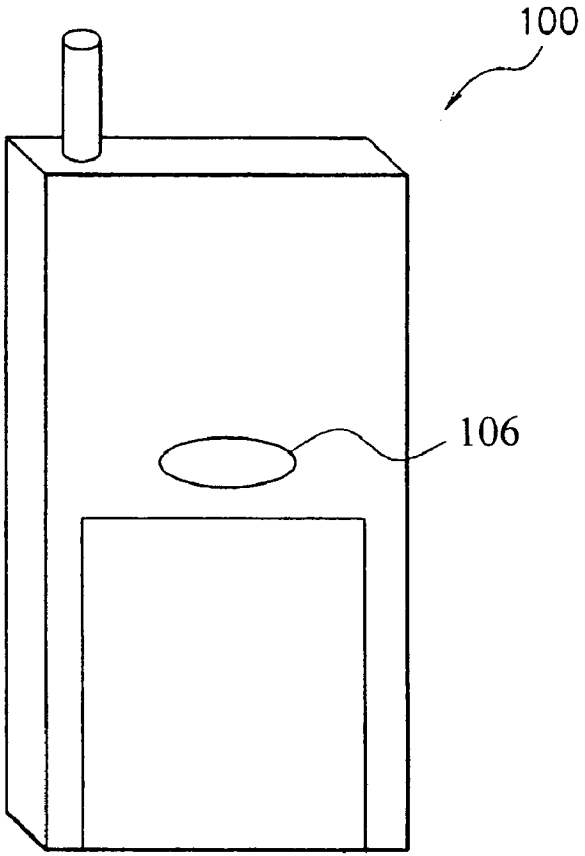
FIG. 1(*a*) is a diagram showing the front view of a cellular phone according to an embodiment of the present invention.
Figure 1:
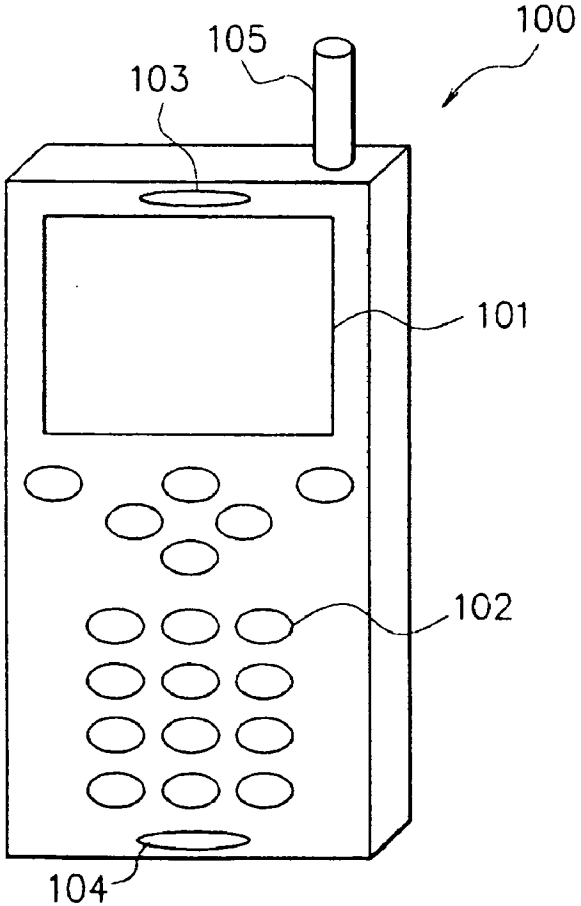

Referring now to the drawings, a description of a preferred embodiment of the present invention will be given in detail.

FIG. 1(*a*) is a diagram showing the front view of a cellular phone according to an embodiment of the present invention. FIG. 1(*b*) is a diagram showing the back view of the cellular phone. Referring to FIG. 1(*a*), the cellular phone 100 is provided on its front with a display 101 capable of color display, an operating section 102 including keys or buttons for inputting telephone numbers, letters, characters or the like to operate the cellular phone, a receiver 103 by which the user listens to the other party in a telephone conversation, a microphone 104 through which the user speaks to the other party on the cellular phone, and an antenna 105 for controlling communication between the cellular phone 100 and a base station. As can be seen in FIG. 1(*b*), the cellular phone 100 is provided on its back with a speaker 106 for generating a ring tone signaling the user of a call in. The display 101, operating section 102, receiver 103, microphone 104, antenna 105, and speaker 106 are connected to a controller 200 shown in FIG. 2, and operate under the control of the controller 200.

Figure 2:
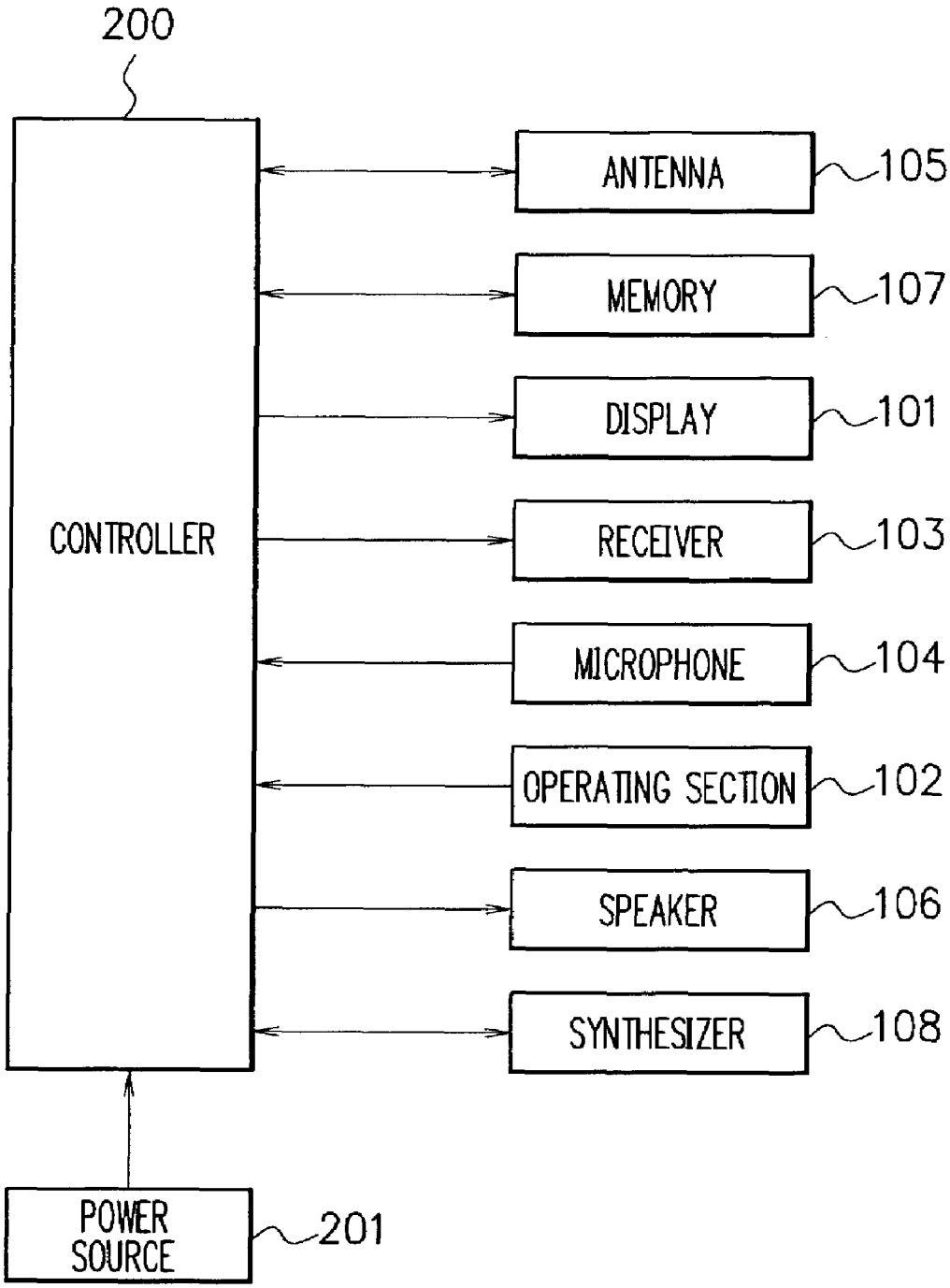
FIG. 2 is a block diagram showing functions of the cellular phone depicted in FIG. 1.

FIG. 2 is a block diagram showing functions of the cellular phone 100. As shown in FIG. 2, the cellular phone 100 further comprises a memory 107 and a synthesizer 108, which are also connected to the controller 200. The memory 107 stores a program to make the cellular phone 100 operate, data processed by the program, settings for the cellular phone 100 and the like. The synthesizer 108 generates sounds. Additionally, a power source 201 for supplying power to the cellular phone 100 is connected to the controller 200.

In the following, the operation of the cellular phone 100 will be described with reference to FIG. 2.

Based on the program and the settings stored in the memory 107, the controller 200 controls the receiver 103, microphone 104, and antenna 105 according to input provided by the operating section 102 so that communication becomes available. When the antenna 105 receives data other than voice data, the controller 200 once stores the data in the memory 107. After having been converted to an appropriate data format, the data is output through the display 101 if it is text or image data, or output through the speaker 106 if it is music data. The input provided by the operating section 102 is stored in the memory 107 according to the program in the memory 107. The result of the processing by the controller 200 is output on the display 101.

Figure 3:
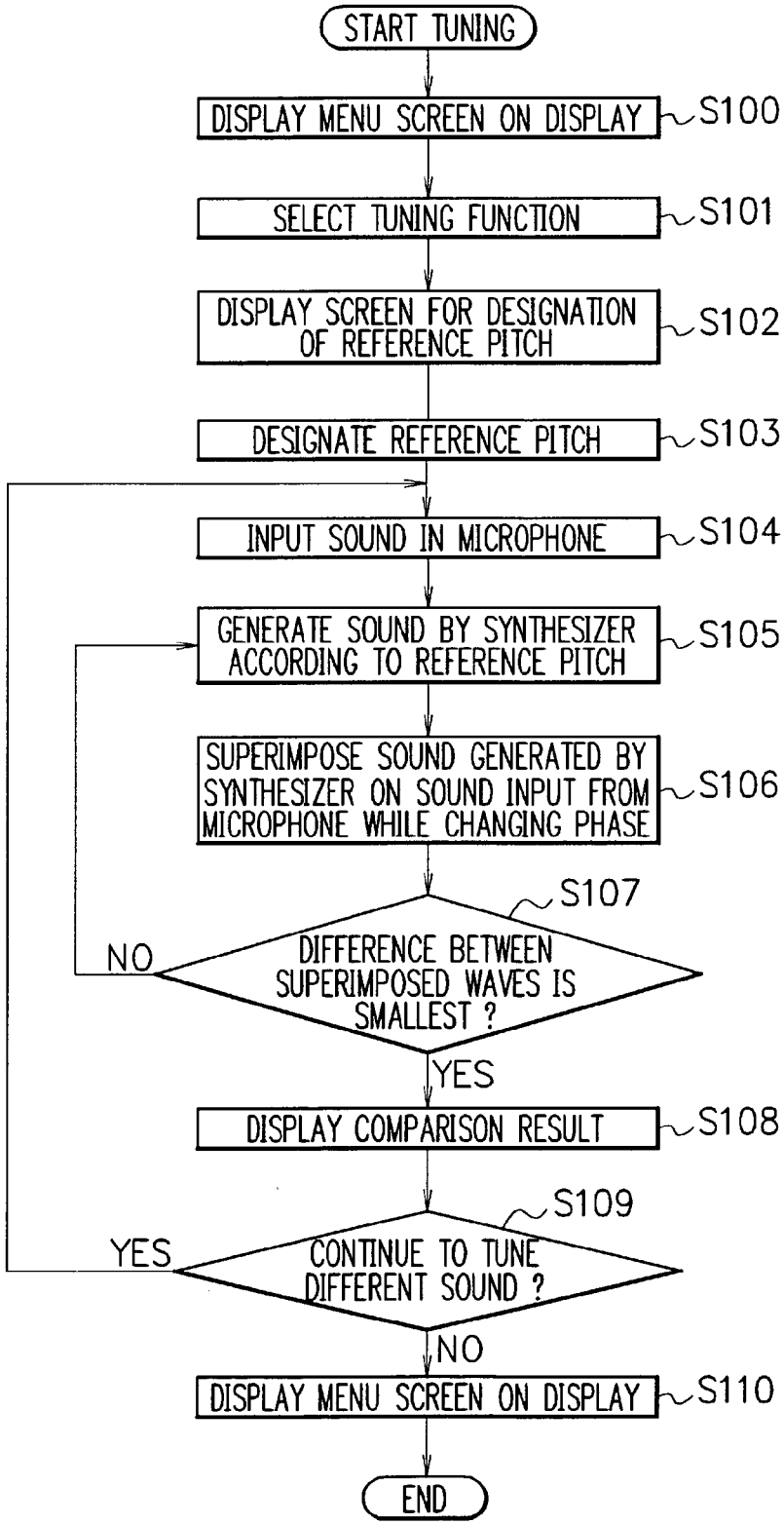
FIG. 3 is a flowchart showing the operation of the cellular phone for performing the tuning function.

FIG. 3 is a flowchart showing the operation of the cellular phone for performing the tuning function. In the following, the audio tuning function of the cellular phone 100 will be described with reference to FIG. 3.

In order to implement the tuning function, the controller 200 reads the program stored in the memory 107 according to the input provided by the operating section 102.

First, a menu screen is displayed on the display 101 (step S100). At this point, if the user has the intention to use the tuning function, he/she operates the operating section 102 to display the menu screen for selecting the tuning function on the display 101. Subsequently, the user selects the tuning function so that it is to be performed on the cellular phone 100 (step S101). Accordingly, the display 101 displays the screen for letting the user designate a reference pitch (step S102). The reference pitch indicates the frequency of a reference tone or note. In general, the frequency of "la" or "A" (the sixth note in C major) is set to around 440 Hz, and based on which, the frequencies of other notes are calculated.

Next, the user operates the operating section 102 to designate a reference pitch (step S103). Having designated a reference pitch, the user inputs the sound of an instrument to be tuned or a voice into the microphone 104 (step S104). The synthesizer 108 generates sounds sequentially from the highest or lowest sound (note) according to the reference pitch designated in step S103 (step S105). The wave of the respective sounds generated by the synthesizer 108 is superimposed on that of the sound input through the microphone 104 in step S104 while the phase of the wave is being scanned or changed (step S106).

The wave of the sound generated by the synthesizer 108 with a varied phase is compared with that of the sound input through the microphone 104 to detect the smallest difference in sound components, such as phase and frequency, between them (step S107). In other words, the two sound waves superimposed one on the other are compared to detect a sound generated by the synthesizer 108 that most approximates the sound input through the microphone 104. This process is repeated to indicate on the display 101, and as a result, the sound generated by the synthesizer 108, which shows the smallest difference in sound components (phase, frequency, etc.) when compared with the sound input in step S104 is displayed (step S108). After that, the user determines whether or not to continue to tune a different sound (step S109). When the tuning is to be continued (step S109, YES), the process returns to step S104. On the other hand, when the tuning is completed (step S109, NO), the menu screen is displayed on the display 101 to finish the tuning.

Incidentally, a reference tone or sound generated by the synthesizer 108 may be supplied to the speaker, which is generally installed in a cellular phone, to thereby output a reference tone easily.

Figure 4:
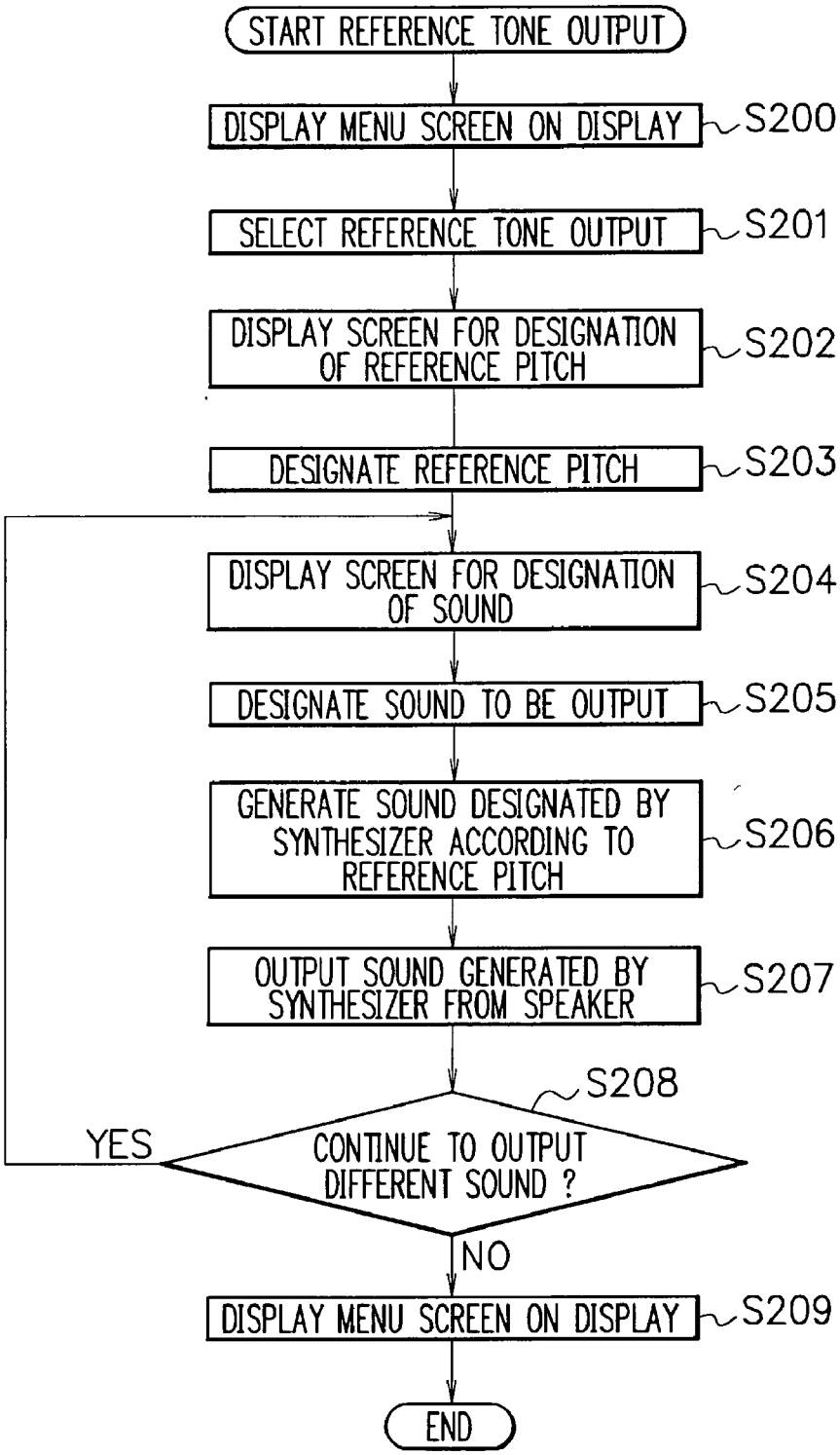
FIG. 4 is a flowchart showing the operation of the cellular phone for outputting a reference tone.

FIG. 4 is a flowchart showing the operation of the cellular phone for outputting a reference tone. Referring to FIG. 4, a description will be given of the operation for outputting a reference tone.

First, a menu screen is displayed on the display 101 (step S200). At this point, the user operates the operating section 102 to display the menu screen for selecting the output of a reference tone on the display 101. Subsequently, the user operates the operating section 102 to select the reference tone output from the menu screen so that it is to be performed on the cellular phone 100 (step S201).

Then, the display 101 displays the screen for letting the user designate a reference pitch (step S202). Thereafter, the user operates the operating section 102 to designate a reference pitch (step S203). After a reference pitch is designated, the display 101 displays the screen for letting the user designate a sound (step S204). The user designates a sound to be output (step S205). The synthesizer 108 generates a sound designated in step S205 according to the reference pitch designated in step S203 (step S206).

On this occasion, the synthesizer 108 generates a sound that has been designated by the user in step 205 and corresponds to the reference pitch designated in step S203. The sound generated by the synthesizer 108 is output from the speaker 106 (step S207). Then, the user determines whether or not to continue the operation for outputting a different sound (step S208). When the operation is to be continued (step S208, YES), the process returns to step S204. On the other hand, when finishing the operation (step S208, NO), the user operates the operating section 102 to display the menu screen on the display 101 to bring the reference tone output to an end.

As set forth hereinabove, in accordance with the present invention, a mobile communication terminal is provided with a tuning function, which saves a player the trouble of carrying around a tuning meter or the like and facilitates the tuning of instruments.

While the present invention has been described with reference to the particular illustrative embodiment, it is not to be restricted by the embodiment but only by the appended claims. It is to be appreciated that those skilled in the art can change or modify the embodiment without departing from the scope and spirit of the present invention.

What is claimed is:

1. A mobile communication terminal with a tuning function, comprising:

a memory for storing a plurality of reference tones for tuning;

a selector for selecting at least one of the reference tones stored in the memory;

an inputting means for inputting an instrumental sound or a voiced sound;

a sound generator for generating a sound whose frequency approximates that of the instrumental sound or the voiced sound input through the inputting means, and which corresponds to the reference tone selected by the selector;

a comparator for comparing the sound generated by the sound generator with the sound input through the inputting means; and a display for displaying the result of the comparison obtained by the comparator.

2. The mobile communication terminal with a tuning function claimed in claim 1, wherein the sound generator generates a sound corresponding to the reference tone selected by the selector to output the sound.

3. The mobile communication terminal with a tuning function claimed in claim 1, wherein the sound generator generates sounds sequentially from the highest or lowest sound based on the reference tone selected by the selector.

4. The mobile communication terminal with a tuning function claimed in claim 1, wherein the sound generator generates a sound corresponding to the reference tone selected by the selector, the mobile communication terminal further comprising a sound wave superimposing means for superimposing the frequency of the sound generated by the sound generator on that of the instrumental sound or the voiced sound input through the inputting means.

5. The mobile communication terminal with a tuning function claimed in claim 4, further comprising a detector for detecting the minimum phase difference and the minimum frequency difference between the two waves superimposed on each other by the sound wave superimposing means.

6. The mobile communication terminal with a tuning function claimed in claim 5, wherein the sound generator generates a sound with the phase and the frequency detected by the detector, and the display indicates the sound generated by the sound generator.

* * * * *